United States Patent [19]

Wickman

[11] 4,240,132

[45] Dec. 16, 1980

[54] ROLLER SKATE LIGHT ASSEMBLY

[75] Inventor: Bobbie L. Wickman, Thousand Oaks, Calif.

[73] Assignee: Midnight Rollers Inc., Ventura, Calif.

[21] Appl. No.: 101,814

[22] Filed: Dec. 10, 1979

[51] Int. Cl.[3] ..... F21L 15/08; A63C 17/14

[52] U.S. Cl. ..... 362/103; 280/11.2; 280/816

[58] Field of Search ..... 280/11.2, 816; 362/103, 362/190, 191, 194

[56] References Cited

U.S. PATENT DOCUMENTS

| | | | |
|---|---|---|---|
| 2,140,224 | 12/1938 | Galgoczy | 280/816 |
| 2,531,959 | 11/1950 | Woodard et al. | 280/816 |
| 3,003,776 | 10/1961 | Ware | 280/11.2 |
| 3,550,824 | 12/1970 | Bohanski | 362/103 X |

FOREIGN PATENT DOCUMENTS

| | | | |
|---|---|---|---|
| 409403 | 5/1934 | United Kingdom | 362/103 |
| 414438 | 8/1934 | United Kingdom | 362/103 |

*Primary Examiner*—Donald A. Griffin
*Attorney, Agent, or Firm*—Ralph B. Pastoriza

[57] ABSTRACT

A light assembly is provided for securement to a roller skate without requiring any alterations in the structure of the skate itself. The light assembly includes a supporting disc member having an integrally formed strip portion curved into a cradle for supporting the light bulb and reflector within a cylindrical casing. The disc member is provided with a central opening and is dimensioned to be received between the conventional toe stop of the roller skate and the underside opposed frame portion of the skate to which the toe stop is secured. It is thus only necessary to remove the toe stop and insert the disc and then replace the toe stop to provide the proper support for the light. The light assembly is completed by the provision of batteries supported in a simple tray structure. This tray structure is designed to grip or otherwise be secured to the underside of the skate frame without again requiring any modification of the skate frame, so that a light is provided for the roller skate for use at night or for decorative purposes.

4 Claims, 2 Drawing Figures

ROLLER SKATE LIGHT ASSEMBLY

This invention relates generally to roller skates and more particularly to a roller skate light assembly which can be attached to a roller skate without requiring any structural modification of the roller skate.

BACKGROUND OF THE INVENTION

Roller skates have again become quite popular and now are generally sold in the form of an entire boot or shoe structure with rollers attached thereto. In addition, presently available roller skates are usually provided with a toe stop such that a person can tilt the skate up on its toe so that the toe stop engages the floor to provide the person with a firm footing when walking around the interior of stores and the like. By such an arrangement, the user does not have to remove his skates.

With the increased popularity of roller skating, many skaters now skate at night. As a consequence, it has been proposed heretofore to provide some type of light for a roller skate not only to illuminate the path along which a person might be skating but also to indicate to others at night that another roller skater is present. Lights proposed heretofore have taken the form of a simple battery operated flashlight strapped or otherwise secured to the skate in some appropriate manner. However, such systems increase greatly the bulk of the skate and it is not always assured that the light will remain fixed to the skate.

In other instances of lights for skates, it has been proposed to provide miniature type lights such as light emitting diodes but these proposals are mainly for the purpose of esthetics; that is, attractive blinking lights when a skater is dancing such as in disco dancing. Such lights would not be sufficient to provide proper illumination of a skater's path.

BRIEF DESCRIPTION OF THE PRESENT INVENTION

With the foregoing considerations in mind, the present invention contemplates the provision of a light assembly particularly designed for modern roller skates which avoids problems heretofore encountered. More particularly, the present invention provides a means for securing a simple flashlight bulb and reflector within a cylindrical casing in a very reliable manner to the roller skate and has means for supporting batteries for energizing the lightbulb in a separated location to the underside of the skate, all to the end that bulk is avoided and yet proper illumination is assured. Moreover, the assembly in accord with this invention can be attached to modern type skates without requiring any structural modification of the skates themselves.

More particularly, the light assembly of this invention includes an integral disc member having a radially outwardly extending strip portion twisted to a given angle and thence curved about an axis to define a concave shaped cradle. The cylindrical body carrying a light bulb and reflector is held in this cradle and the disc portion itself is sandwiched between the toe stop and under front portion of the skate frame so that proper securement is realized without having to modify the skate in any way except to remove the toe stop and replace it.

Batteries for energizing the light bulb of this invention are held in a small tray which in turn is designed to be clipped or otherwise supported to the underside of the skate frame between the front and rear wheels.

The entire assembly is easy to attach and remove and is fairly small so that bulk is avoided. Further, the direction of the light is straightforward to thereby properly illuminate the path of the skater and also serve as a warning to cars in the area.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
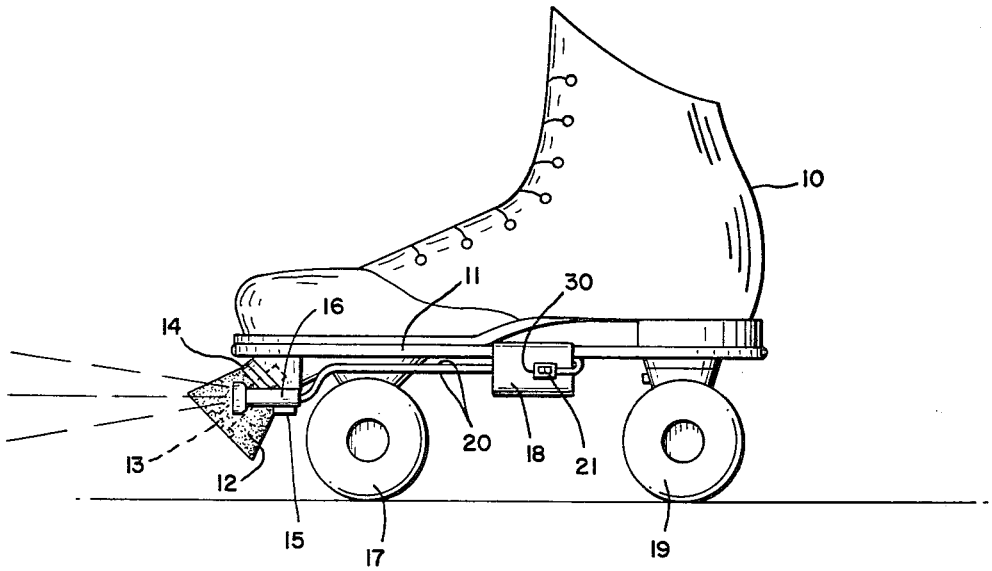
FIG. 1 is a side elevational view of a roller skate incorporating the light assembly of this invention; and, FIG. 2 is a greatly enlarged fragmentary exploded view of the basic components of the light assembly and of the portions of the roller skate to which the light assembly is secured useful in explaining the overall operation of the invention.

Referring first to FIGURE 1, there is shown a conventional type roller skate 10 having a roller skate frame 11 with the usual toe stop member 12. Toe stop member 12 is secured to the underfront portion of the skate frame 11 as by an appropriately threaded bolt 13 shown in phantom lines in FIGURE 1.

The light assembly itself, as will become clearer as the description proceeds, includes an integral disc member 14 arranged to be sandwiched between the toe stop 12 and front frame portion of the skate as shown. This disc 14 includes an integrally outwardly extending strip portion curved into a cradle 15 for supporting a cylindrical housing 16. Housing 16 in turn incorporates a light bulb and appropriate reflector and is forward of the front wheels 17 of the skate and in an horizontal position to shine forwardly when the skate is level.

Energy for the light bulb is supplied by batteries carried in a tray structure 18 secured to the underside of the frame 11 between the front wheels 17 and rear wheels 19 of the skate. Appropriate electrical leads 20 connect from the batteries in the tray 18 to the light bulb in the cylindrical casing 16. A switch 21 may be provided on the side wall of the tray to turn the light on and off.

Figure 2:
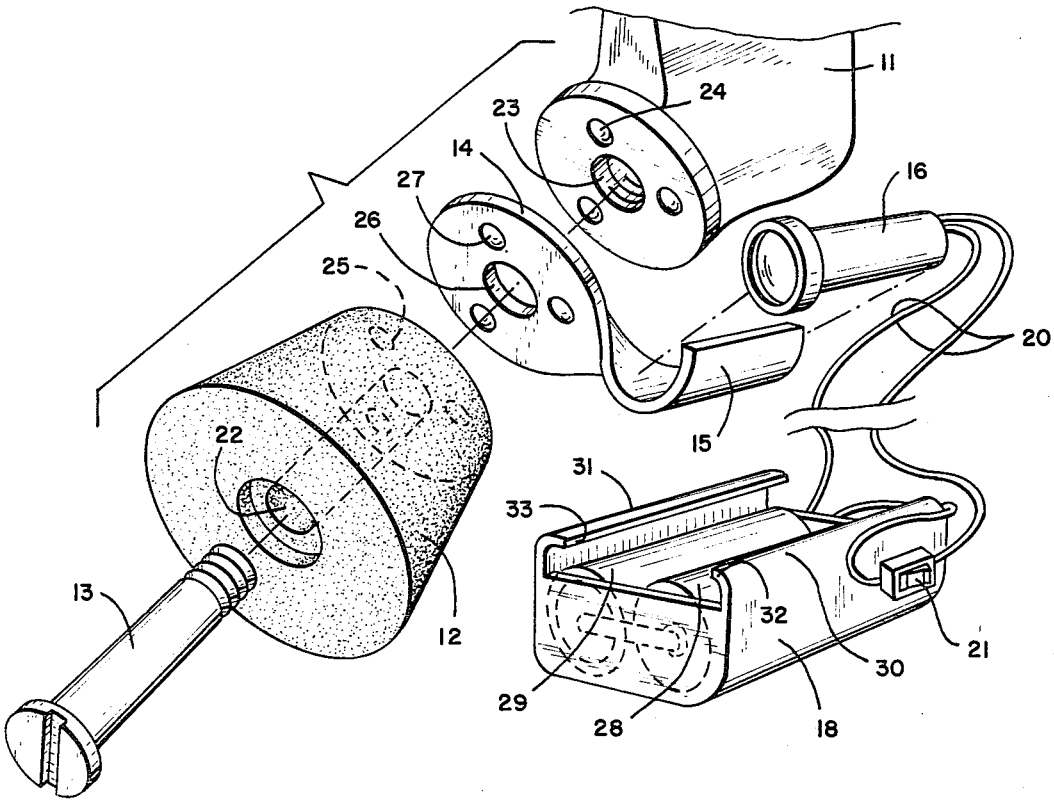

Referring now to FIG. 2, further details of the above-described light assembly will become evident.

More particularly, in FIG. 2, the toe stop 12 is shown removed from the skate frame 11 preparatory to securing the light assembly integral disc member 14 between the toe stop and the skate frame. In this respect, it will be noted that there is provided a central bore 22 in the toe stop 12 for receiving the threaded bolt 13. Normally, this bolt will thread into internal threads 23 formed in the frame structure 11 to hold the toe stop 12 secure. Appropriate locating projections 24 are provided to be received in appropriate cavities 25 on the opposed surface of the toe stop 12 to lock the toe stop against rotation.

The integral disc 14 as shown in FIG. 2 is provided with a central opening 26 for registration with the bore 22 in the toe stop. Appropriately devised locating pin cavities such as indicated at 27, in turn, are provided for receiving the projections 24 and for reception into the cavities 25 respectively, so that the disc 14 when sandwiched between the toe stop 12 and the frame structure 11 is locked in rotation.

The extending strip portion defining the cradle 15 is clearly illustrated in FIG. 2, the light bulb and reflector casing 16 shown exploded away from the cradle.

In addition, the tray 18 is more clearly illustrated in FIG. 2 wherein appropriate batteries indicated at 28 and 29 are secured within the tray and arranged to be connected in series to the leads 20. One of the leads 20 connects to the switch 21 as shown.

While the tray 18 may be secured to the underside of the skate by any appropriate temporary means, the preferred method of attachment constitutes the provision of upwardly extending side walls 30 and 31 having inwardly turned portions 32 and 33 so dimensioned as to clip over opposite edges of the skate frame 11 as illustrated in FIG. 1. To remove the tray, it is thus only necessary to bias apart the inwardly turned edge portions 32 and 33. As mentioned, any other suitable means for securing a tray to support the batteries between the front and rear wheels may be provided.

OPERATION

In operation, a person need only remove the toe stop 12 by unthreading the bolt 13, insert the disc between the toe stop and the opposing frame portion and then reapply the bolt 13, making sure that the locating projections and cavities such as indicated at 24, 27 and 25 are in proper alignment. The tray 18 is then clipped to the underside of the skate frame and at night the switch 21 operated to turn on the light.

The batteries can be replaced by simply removing the tray and replacing the batteries. The entire structure can be removed if desired by reversing the foregoing steps.

From all of the foregoing, it will thus be evident that the present invention has provided a very convenient light assembly for use on roller skates which can be readily attached and removed without having to structurally alter the roller skates themselves.

I claim:

1. A light assembly for a roller skate having a skate frame with a toe stop member and threaded bolt for securing the toe stop member to the under front portion of the skate frame ahead of the front skate wheels, said light assembly including, in combination:

(a) an integral disc member having a radially outwardly extending strip portion twisted through a given angle and thence curved about an axis to define a concave shaped cradle;

(b) a lightbulb and reflector structure supported in a generally cylindrical body dimensioned to be received and secured in said cradle, said disc having a central opening so that it can be sandwiched between said toe stop and under front portion of said skate frame with said threaded bolt passing through said disc to thereby secure the disc to the skate frame, said given angle of twisting of said strip portion being such that the axis of said cradle and cylindrical body supported therein is generally horizontal when said skate is level; and, (c) battery means for energizing said light bulb to thereby provide a light for said roller skate which can be secured to and removed from said roller skate without having to make any alterations in the structure of said roller skate.

2. A light assembly for a roller skate according to claim 1, in which said disc includes three locating projections arranged to register with corresponding depressions normally provided on said toe stop so that said disc is consistently oriented when secured between said toe stop and said skate frame.

3. A light assembly for a roller skate according to claim 1, in which said battery means includes a battery tray; dry cell batteries carried in said tray; wire leads connecting said batteries to said light bulb; switch means in one of said leads for energizing and de-energizing said light bulb; and means for securing said tray to the underside of said skate frame between the front and rear wheels of the roller skate.

4. A light assembly according to claim 3, in which said means for securing said tray to the underside of said skate frame includes upwardly extending side walls on said tray terminating in inwardly directed top edges dimensioned to snap over opposite side edges of said skate frame to thereby support said tray, said switch means being secured to a side portion of said tray for manual operation.

* * * * *